US009163315B2

(12) United States Patent
Kapic et al.

(10) Patent No.: US 9,163,315 B2
(45) Date of Patent: Oct. 20, 2015

(54) PRETREATMENT PROCESS FOR ALUMINUM AND HIGH ETCH CLEANER USED THEREIN

(75) Inventors: Edis Kapic, Sterling Heights, MI (US); Michael L. Sienkowski, Warren, MI (US); Bruce H. Goodreau, Romeo, MI (US); Sophie Cornen, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 53 days.

(21) Appl. No.: 13/531,701

(22) Filed: Jun. 25, 2012

(65) Prior Publication Data

US 2012/0301351 A1 Nov. 29, 2012

Related U.S. Application Data

(63) Continuation of application No. PCT/US2010/062125, filed on Dec. 27, 2010.

(60) Provisional application No. 61/290,279, filed on Dec. 28, 2009.

(51) Int. Cl.

| | |
|---|---|
| ***C23G 1/22*** | (2006.01) |
| ***C11D 7/06*** | (2006.01) |
| ***C11D 7/26*** | (2006.01) |
| ***C11D 7/32*** | (2006.01) |
| ***C11D 11/00*** | (2006.01) |
| ***C23C 22/78*** | (2006.01) |
| ***C23F 1/36*** | (2006.01) |

(52) U.S. Cl.

CPC .. *C23G 1/22* (2013.01); *C11D 7/06* (2013.01); *C11D 7/265* (2013.01); *C11D 7/3245* (2013.01); *C11D 11/0029* (2013.01); *C23C 22/78* (2013.01); *C23F 1/36* (2013.01)

(58) Field of Classification Search

CPC ..... C11D 7/06; C11D 7/265; C11D 7/3245; C11D 11/0029; C23G 1/22; C23C 22/78; C23F 1/36

USPC ..... 134/2, 3, 4, 41; 205/50; 438/745; 510/130, 184, 218, 245, 254, 255, 365

See application file for complete search history.

(56) References Cited

U.S. PATENT DOCUMENTS

| | | | | |
|---|---|---|---|---|
| 4,775,427 | A * | 10/1988 | Portz et al. | 148/254 |
| 5,110,494 | A * | 5/1992 | Beck | 134/41 |
| 7,709,435 | B2 | 5/2010 | Hino et al. | |
| 2007/0080319 | A1 | 4/2007 | Fukumura et al. | |
| 2008/0234164 | A1 | 9/2008 | Tyborski | |

FOREIGN PATENT DOCUMENTS

| | | | |
|---|---|---|---|
| CN | 101130870 | | 2/2008 |
| EP | 1888816 | B1 | 2/2008 |
| JP | 6116768 | | 4/1994 |
| JP | 06116768 | A | 4/1994 |
| JP | 2005-097726 | | 11/2005 |
| JP | 2008-542536 | | 11/2008 |
| KR | 2006-0101524 | | 9/2006 |

OTHER PUBLICATIONS

International Search Report for PCT/US2010/062125, 2 pages.
Chinese Search Report, 2 Pages.

* cited by examiner

*Primary Examiner* — Duy Deo
*Assistant Examiner* — Erin Bergner
(74) *Attorney, Agent, or Firm* — Mary K. Cameron

(57) ABSTRACT

A high etch cleaner for aluminum and aluminum alloy substrates that leads to enhanced corrosion protective performance of a variety of anti-corrosion pretreatments. The cleaner comprises low levels of silicate of from 0 to 250 ppm, 50 to 500 ppm of at least one chelator, and has a pH of from 11.0 to 13.5. The cleaner may be used to etch from 0.5 to 4.0 grams per meter squared from substrates. Substrates treated with the cleaner and then coated with a variety of anti-corrosion pretreatments and outer coatings show enhanced corrosion resistance compared to substrates cleaned with standard cleaners that have low etch rates, high silicate levels and no chelating agents followed by anti-corrosion pretreatments and outer coatings.

10 Claims, No Drawings

PRETREATMENT PROCESS FOR ALUMINUM AND HIGH ETCH CLEANER USED THEREIN

This application is a continuation of PCT/US2010/062125, filed Dec. 27, 2010, which claims the benefit of U.S. provisional application Ser. No. 61/290,279, filed on Dec. 28, 2009.

FIELD OF THE INVENTION

This invention relates generally to cleaning of aluminum based substrates prior to application of an anti-corrosion pretreatment and more particularly to a cleaner that produces a high etch rate of the aluminum based substrate leading to enhanced corrosion performance of a subsequently applied anti-corrosion pretreatment coating.

BACKGROUND OF THE INVENTION

An anti-corrosion pretreatment coating is often applied to metal substrates, especially if the substrate will be exposed to the elements in use, prior to the application of outer decorative or protective coatings. These pretreatment coatings are designed to minimize corrosion of the metal substrate, if and when the substrate is exposed to moisture and oxygen. One common metal substrate comprises aluminum or aluminum alloys. These substrates find particular use in the automotive industry, aerospace industry and others wherein a light weight strong metal substrate is required. These substrates are typically initially treated with an alkaline cleaner to remove oil and other surface debris prior to application of a corrosion resistant pretreatment layer. Such alkaline cleaners include Parco® Cleaner 1533 available from Henkel Adhesive Technologies. Typical anti-corrosion pretreatments used after the cleaning step include zinc phosphate based treatments such as the Bonderite® systems or the zirconium oxide based TecTalis® systems. Both of these are available from Henkel Adhesive Technologies. Key to application of these pretreatments is adequate cleaning of the substrates with the alkaline cleaners. In a typical automotive process the substrate is initially cleaned with an alkaline cleaner, rinsed with water, treated with a pretreatment coating, rinsed again with water and then coated in order with an electro-coating, a primer, a base paint coat, and a clear coat.

Aluminum and its alloys are particularly susceptible to corrosion of a filiform type. Filiform corrosion appears as small thread-like formations under organic coatings on aluminum substrates. The initiation is usually at a scratch or defect in the coating. The corrosion filament propagates by an anodic undermining reaction. The aluminum surface at the front of the filament is corroded causing the coating to detach from the substrate and get pushed up by the corrosion products that form in the filament. Typically the corrosion occurs at humidity levels of from 40 to 90% and they follow a pre-existing directionality. It has been observed in the past that the formation of filiform corrosion is especially evident in aluminum alloys that have copper levels of 0.5% by weight or higher. The aluminum substrates are also more susceptible if they experience mechanical stress during the production process such as sanding operations. Although attempts have been made to reduce filiform corrosion, they have not met with complete success and there is a need for improved filiform corrosion resistance particularly in zirconium based coatings and in coatings in general on aluminum alloys having copper levels of greater than or equal to 0.5 weight %.

It is desirable to enhance the corrosion resistance provided to aluminum substrates by standard anti-corrosion pretreatments such as zinc phosphate or zirconium based pretreatments. It is desirable to provide this enhancement in a manner that requires minimal change to existing processes and in a cost effective manner. Preferably the cleaner will also enhance corrosion protection of mechanically stressed aluminum or aluminum alloy substrates. Finally, the cleaner preferably will be applicable to a variety of pre-treated aluminum and aluminum alloy substrates.

SUMMARY

In general terms, this invention provides an alkaline cleaner for aluminum and aluminum alloy substrates that enhances the corrosion protection provided by a subsequent anti-corrosion pretreatment coating applied to the substrate. The inventive cleaner is designed to have a high etch rate on aluminum and aluminum alloy substrates. This is accomplished by providing a cleaner having a higher pH of from 11.0 or higher, much reduced silicate levels of from 0 to 250 parts per million (ppm) and including 50 to 500 ppm of at least one chelating agent to enhance removal of residual alloying elements released during the cleaning process. Chelating agents can be used alone or in any combination and preferred ones for the present invention include: ethylenediamine tetraacetic acid or its salts (EDTA); nitrilo triacetic acid or its salts (NTA); diethylene triamine pentaacetic acid or its salts (DTPA); iminodisuccinic acid or its salts; S,S'-ethylenediaminedisuccinic acid or is salts (EDDS); tartaric acid or its salts. Substrates cleaned with the cleaner of the present invention show enhanced corrosion resistance compared to substrates cleaned with the standard low etch cleaners having a lower pH, much higher silicate levels and none of the above chelating agents. Typical cleaners include phosphates and gluconates to soften the water by reacting with Mg and Ca ions in the water. The cleaner according to the present invention does not required any change to existing processing for aluminum substrates and can be readily substituted for existing cleaners. Preferably the cleaner of the present invention is used to produce a target etch of from 0.5 to 4.0 grams/meter$^2$, preferably from 0.5 to 3.0 grams/meter$^2$ on aluminum and aluminum alloy substrates. The cleaner according to the present invention preferably has a silicate level in the cleaning bath or spray of from 0 to 250 parts per million (ppm), which is much lower than the typical cleaner level for silicate of from 650 ppm and up. Preferably the pH of the inventive cleaner is from 11.0 to 13.5, more preferably from 11.0 to 12.5. The cleaner preferably includes as a chelating agent at least EDTA or its salts and may include any combination of the other chelating agents discussed above as preferred such as NTA or its salts, DTPA or its salts, iminodisuccinic acid or its salts, EDDS or its salts, or tartaric acid or its salts. These chelating agents are present at levels of from 50 to 500 ppm and prevent alloying elements, such as copper, released during the cleaning process from being loosely re-deposited onto the substrate. Such re-depositing can lead to decreased corrosion resistance of subsequently applied pretreatments and coating layers. The cleaner composition can be provided as a ready to use solution or as a concentrated composition designed to be diluted with water prior to use. Therefore the preferable levels of silicate, chelating agent, pH and other parameters of the cleaner described in the present specification and as claimed in the present claims refer to the levels when the cleaner is diluted to use strength, unless noted otherwise.

In one embodiment, the present invention is a cleaner for aluminum and aluminum alloy substrates comprising: 0 to 250 ppm of silicate; 50 to 500 ppm of at least one chelator selected from the group consisting of ethylenediamine tetraacetic acid (EDTA) or its salts, nitrilo triacetic acid (NTA) or its salts, diethylene triamine pentaacetic acid (DTPA) or its salts, iminodisuccinic acid or its salts, S,S'-ethylenediaminedisuccinic acid (EDDS) or its salts, tartaric acid or its salts, and any mixture thereof; and the cleaner having a pH of from 11.0 to 13.5 and providing an etch capability of from 0.5 to 4.0 grams per meter squared of an aluminum or aluminum alloy substrate.

In another embodiment the present invention is a concentrated cleaner for aluminum or aluminum alloy substrates comprising: a concentrated cleaner that when mixed with water at a level of from 6 to 27 grams of concentrated cleaner per liter of water produces a cleaner having a pH of from 11.0 to 13.5 and comprising: 100 to 1235 ppm of sodium; 880 to 3950 ppm of potassium; 510 to 1790 ppm of hydroxide; 50 to 500 ppm of at least one chelator selected from the group consisting of ethylenediamine tetraacetic acid (EDTA) or its salts, nitrilo triacetic acid (NTA) or its salts, diethylene triamine pentaacetic acid (DTPA) or its salts, iminodisuccinic acid or its salts, S,S'-ethylenediaminedisuccinic acid (EDDS) or its salts, tartaric acid or its salts, and any mixture thereof; 0 to 775 ppm of at least one phosphate; 0 to 270 ppm of tartrate; 0 to 250 ppm of silicate; 0 to 180 ppm of gluconate; and 0 to 340 ppm of nitrate. The at least one phosphate can comprise a tripolyphosphate, a trimetaphosphate, an orthophosphate, a pyrophosphate, a tetraphosphate, or a mixture thereof.

In another embodiment the present invention is a method of cleaning an aluminum or aluminum alloy substrate comprising the steps of: providing a cleaner comprising 0 to 250 ppm of silicate, 50 to 500 ppm of at least one chelator selected from the group consisting of ethylenediamine tetraacetic acid (EDTA) or its salts, nitrilo triacetic acid (NTA) or its salts, diethylene triamine pentaacetic acid (DTPA) or its salts, iminodisuccinic acid or its salts, S,S'-ethylenediaminedisuccinic acid (EDDS) or its salts, tartaric acid or its salts, and any mixture thereof, the cleaner having a pH of from 11.0 to 13.5; and exposing a substrate comprising aluminum or an aluminum alloy to the cleaner for a period of time sufficient to etch from 0.5 to 4.0 grams per square meter of aluminum from the substrate. In the method the cleaner can further comprise providing a cleaner comprising: 100 to 1235 ppm of sodium, 880 to 3950 ppm of potassium, 510 to 1790 ppm of hydroxide, 0 to 775 ppm of at least one phosphate, 0 to 270 ppm of tartrate, and 0 to 340 ppm of nitrate. The method can also include an embodiment wherein the at least one phosphate comprises a tripolyphosphate, a trimetaphosphate, an orthophosphate, a pyrophosphate, a tetraphosphate, or a mixture thereof. The method includes exposing the substrate to the cleaner at a temperature of from 110 to 140° F. (43.3 to 60.0° C.). The method of exposing comprises at least one of spraying the cleaner onto the substrate, immersing the substrate in a bath of the cleaner, or a mixture thereof. IN another embodiment the method comprises first spraying the cleaner onto the substrate followed by immersion of the substrate in a bath of the cleaner. The step of spraying can comprise spraying the cleaner onto the substrate for a period of time of at least 60 seconds. The immersion can comprise immersing the substrate into the cleaner for a period of time of at least 120 seconds. Preferably, after exposure to the cleaner and etching the substrate is rinsed with water. The method can include the further step of applying to the rinsed substrate an anti-corrosion pretreatment.

These and other features and advantages of this invention will become more apparent to those skilled in the art from the detailed description of a preferred embodiment. Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counter ions to produce electrical neutrality for the composition as a whole (any counter ions thus implicitly specified should preferably be selected from among other constituents explicitly specified in ionic form, to the extent possible; otherwise such counter ions may be freely selected, except for avoiding counter ions that act adversely to the objects of the invention).

DETAILED DESCRIPTION

The present invention is directed toward an alkaline cleaner that is designed to etch aluminum and aluminum alloy substrates as a first step prior to any anti-corrosion pretreatment or other coating process. The alkaline cleaner not only removes surface debris but also enhances the corrosion resistance of subsequently applied pretreatments designed to prevent corrosion. The cleaner is especially useful for aluminum substrates having copper levels of 0.5% by weight and higher.

Current cleaner solutions are comprised of components to achieve alkaline pH, provide high levels of silicate and have no chelating agents like those described as preferred for the present invention. They are typically applied by spraying onto the substrate followed by an immersion in a cleaner bath with agitation. As discussed above a typical process for producing a finished coated aluminum substrate will include the following steps in order: application of a cleaner solution; rinse in warm water; application of an anti-corrosion pretreatment coating; deionized water rinse; compressed air drying of the substrate; application of an initial layer by electrodeposition generally with baking; application of a primer layer; application of a basecoat layer; and finally application of a clearcoat layer.

The present inventors have surprisingly found that modification of the standard alkaline cleaner composition can lead to enhanced corrosion resistance of aluminum alloy substrates that are subsequently coated with an anti-corrosion pretreatment and painted per industry standards. The modifications are designed to create a high etch cleaner and include the following changes: reduction of silicate levels; increasing the pH to 11.0 or higher; and addition of at least one chelator comprising EDTA or its salts and may include any combination of the other chelating agents discussed above as preferred such as NTA or its salts, DTPA or its salts, iminodisuccinic acid or its salts, EDDS or its salts, or tartaric acid or its salts.

The cleaner according to the present invention has much reduced levels of silicate of from 0 to 250 ppm, whereas a standard cleaner has 650 ppm or more. Preferably the silicate level in ppm of the cleaner at use levels ranges upward from, in order of increasing preference, 0, 25, 50, 75, 100, and 125 and ranges downward from, in order of increasing preference from 250, 225, 200, 175, 150, 125. The cleaner includes 50 to 500 ppm of at least one chelator selected from the group consisting of EDTA or its salts, NTA or its salts, DTPA or its salts, iminodisuccinic acid or its salts, EDDS or its salts, tartaric acid or its salt, or any combination thereof. The standard cleaners for aluminum or aluminum alloy substrates do not include any of these chelating agents. Preferably the level of any chelator in ppm of the cleaner at use levels ranges upward from, in order of increasing preference, 50, 75, 100, 125, 150, 175, 200, 225, 250, 275 and ranges downward from, in order of increasing preference, 500, 475, 450, 425, 400, 375, 350, 325, 300, 275. The pH of the cleaner of the present invention is 11.0 or greater. It can range from 11.0 to 13.5 provided it is not so alkaline as to destabilize the cleaner or to cause excessive etching of the substrate. Preferably, the pH is from 11.0 to 13.5, more preferably from 11.0 to 12.5.

Other components that can be included in the cleaner of the present invention include 0 to 1235 ppm of sodium, 0 to 3950 ppm of potassium, 510 to 1790 ppm of hydroxide, 0 to 775 of at least one phosphate, 0 to 270 ppm of tartrate, 0 to 340 ppm of nitrate and 0 to 180 ppm of gluconate. The phosphate can come from any combination of tripolyphosphate, trimetaphosphate, orthophosphates, pyrophosphates, and tetraphosphates.

The cleaner of the present invention can be applied to aluminum or aluminum alloy substrates in any manner including as a spray application, as an immersion bath, or as a combination of a spray and immersion bath. In the usual process the cleaner is applied for a first period of time as a spray followed by application via an immersion bath for a second period of time. The usual periods of time for a spray application range from 30 to 120 seconds and the time for an immersion bath range from 60 seconds to 120 seconds. The spray application and/or immersion bath is preferably at a temperature of from 110 to 140° F. (43.3 to 60.0° C.). The times and temperatures of the applications of the cleaner are selected to provide an etch amount in the aluminum or aluminum alloy of from 0.5 to 4.0 grams per meter squared. The etch rate ranges upward in grams per meter squared from, in order of increasing preference, 0.5, 0.75, 1.0, 1.25, 1.50, 1.75, 2.0, 2.25 and ranges downward from, in order of increasing preference 4.0, 3.75, 3.50, 3.25, 3.0, 2.75, 2.5, 2.25. The aluminum or aluminum alloy substrates can be pre-treated prior to the cleaning step in a variety of typical ways including acid rinsed, rolled and heat treated, acid etched, alkaline etched, or Ti and Zr treated. The cleaner can also be used on mechanically stressed substrates. The cleaner can be used on aluminum alloys having a wide range of copper concentrations without losing its effectiveness. In addition, the cleaner can be used even after aging which occurs after repeated use. With repeated use the cleaners pick up oils and other materials brought in on the substrates. The present cleaner is unaffected by aging simulated by adding a typical substrate oil to the cleaning composition. The cleaner of the present invention enhances the corrosion resistance provided by a wide variety of anti-corrosion pretreatments. This is evidenced by a large reduction in filiform corrosion formation in substrates that are treated with the cleaner followed by anti-corrosion pretreatment and then subjected to a variety of corrosion testing protocols. The cleaner effectiveness in enhancing corrosion resistance is increased by reducing silicate levels, increasing the pH and including at least one of the chelators discussed above. The cleaner can be provided at a ready to use strength or as a concentrate that is diluted with water prior to its use.

The present invention comprises an alkaline cleaner bath for aluminum and aluminum alloy substrates having high etch capability. In use the cleaner solution preferably has a very low level of silicate of from 0 to 250 ppm, more preferably from 0 to 200 ppm. The pH of the cleaner solution is preferably from 11.0 to 13.5, more preferably from 11.0 to 12.5. The cleaner solution further includes from 50 to 500 ppm of EDTA or its salts when in use. Preferably the cleaner is used at temperatures of from 110 to 140° F. (43.3 to 60.0° C.). The targeted etch rate of the substrates is preferably from 0.5 to 3.0 grams per meter squared, preferably following an exposure time of 60 seconds or more. Actual exposure times can be varied depending on temperature of exposure, substrate and cleaner composition. Also as seen in Table 9 etch rates can be as high as about 4.0 grams per meter squared and still produce reduced filiform corrosion. Optional chelating agents include any combination with EDTA or its salts of other chelating agents discussed above as preferred such as NTA or its salts, DTPA or its salts, iminodisuccinic acid or its salts, EDDS or its salts, or tartaric acid or its salts used at a levels of from 50 to 500 ppm in the cleaner.

In TABLE 1 below two working formulas for cleaners according to the present invention are presented and labeled cleaner 1 and cleaner 2. Cleaner 1 can be used at concentrations of from 8 to 27 grams/liter while cleaner 2 can used at levels of from 6 to 20 grams/liter. When used at these levels the ranges of components and conditions range as shown in TABLE 2 below. Other potassium or sodium phosphates can be used in place of those listed and include orthophosphates, pyrophosphates, tetrapolyphosphates, and other condensed phosphates.

TABLE 1

| Component | Cleaner 1 % by weight | Cleaner 2 % by weight |
|---|---|---|
| Deionized water | 46.575 | 25.80 |
| Sodium tripolyphosphate | 3.27 | 0.00 |
| Sodium trimetaphosphate | 0.00 | 5.00 |
| Potassium hydroxide (45%) | 35.25 | 63.00 |
| Sodium hydroxide (50%) | 8.57 | 0.00 |
| Tetrasodium EDTA | 1.32 | 3.20 |
| Tartaric acid | 1.00 | 0.00 |
| Sodium silicate grade 40 | 2.14 | 2.00 |
| Sodium nitrite | 1.875 | 0.00 |
| Sodium gluconate | 0.00 | 1.00 |

TABLE 2

| Component | Cleaner 1 | Cleaner 2 |
|---|---|---|
| Sodium | 370-1235 ppm | 100-325 ppm |
| Potassium | 880-2985 ppm | 1185-3950 ppm |
| Tripolyphosphate | 180-610 ppm | 0 ppm |
| Trimetaphosphate | 0 ppm | 230-775 ppm |
| Hydroxide | 510-1730 ppm | 520-1790 ppm |
| EDTA | 80-270 ppm | 150-485 ppm |
| Tartrate | 80-270 ppm | 0 ppm |
| Gluconate | 0 ppm | 50-180 ppm |
| Silicate | 50-170 ppm | 50-120 ppm |
| Nitrite | 100-340 ppm | 0 ppm |
| Free alkalinity | 3-10 points | 3-10 points |
| pH | 11.5-12.5 | 11.5-12.5 |
| Working temperature | 110-140° F. | 110-140° F. |

The present invention finds wide industrial use in cleaning of a wide variety of aluminum and aluminum alloy substrates prior to application of anti-corrosion pretreatments. The cleaner of the present invention can be used without altering current methods for cleaning aluminum or aluminum alloy substrates. Substrates cleaned with the present cleaner have much enhanced corrosion resistance after application of standard anti-corrosion pretreatments compared to substrates cleaned with current cleaners.

Examples

In a first series of tests a standard cleaner was modified to have reduced levels of silicate, the pH was varied and the level of EDTA was varied. The standard cleaner was prepare by adding 26.0 grams/liter of a composition comprising 50% by weight deionized water, 46.97% by weight potassium hydroxide, and 3.03% by weight sodium trimetaphosphate to water. The standard cleaner further included 1.6 grams/liter of surfactant and 0.3 grams/liter of sodium gluconate. The pH of the cleaner solutions was adjusted using sodium bicarbonate. The standard cleaner was modified as indicated below in TABLE 3 by adjusting the sodium silicate and EDTA levels and by adjusting the pH. The substrate was ACT aluminum alloy 6022, which has a copper level of from 0.01 to 0.11% by weight. The substrate was treated as follows for the etching studies: the substrate was initially cleaned with an acetone dip; the cleaner was applied for 120 seconds; then a warm water rinse was applied and the panels were dried. The loss of aluminum due to etching in units of grams per meter squared was determined for each panel. The results are the average of multiple panels for each condition. The sanded panels were sanded on both sides using 180 grit sand paper to simulate working of the substrate prior to cleaning. The panels tested for filiform creep were prepared as follows after being sanded as described above. The panels were subjected to the selected cleaner for 120 seconds at 120° F. (48.9° C.) in a bath; rinsed for 30 seconds with warm water; conditioned for 30 seconds with a spray of the anti-corrosion pretreatment and then placed in a bath of the anti-corrosion pretreatment for 120 seconds at 110° F. (43.3° C.). The panels were then rinsed for 30 seconds with cold water; rinsed for 30 seconds with deionized water; and then air dried. The anti-corrosion pretreatment used was Bonderite® 3042 phosphate treatment available from Henkel Adhesive Technologies. The dried panels were then painted using in order: PPG lead free e-coat, PPG White basecoat, and PPG clearcoat. The painted panels were then scribed using a knife to the base substrate; the scribe length was 10 centimeters. The test panels were fixed at an angle of from 15 to 30 degrees from vertical and subjected to a 5% NaCl salt spray at a pH of 6.5 to 7.2 for 24 hours. The panels were then kept in a thermo-hydrostat at 40° C. and 70% relative humidity for 240 hours. This treatment cycle was repeated 4 times and then the length of filiform corrosion was determined per industry standards, the smaller the creep number the less the corrosion. The cleaner compositions, etch results and filiform corrosion results are presented below in TABLE 3.

TABLE 3

| Cleaner | Silicate ppm | EDTA ppm | pH | Unsanded substrate, metal loss g/m$^2$ | Sanded substrate, metal loss g/m$^2$ | Filiform creep mm/10 cm |
|---|---|---|---|---|---|---|
| Standard | 650 | 0 | 12 | 0.065 | 0.000 | 15.2 |
| Standard + EDTA | 650 | 500 | 12 | 0.097 | 0.032 | 11.9 |
| Modified | 250 | 100 | 11 | 0.039 | 0.052 | 9.2 |

TABLE 3-continued

| Cleaner | Silicate ppm | EDTA ppm | pH | Unsanded substrate, metal loss g/m$^2$ | Sanded substrate, metal loss g/m$^2$ | Filiform creep mm/10 cm |
|---|---|---|---|---|---|---|
| Modified | 250 | 100 | 12 | 0.675 | 0.746 | 7.7 |
| Modified | 250 | 300 | 11.5 | 0.284 | 0.329 | 12.5 |
| Modified | 250 | 500 | 11 | 0.029 | 0.039 | 8.5 |
| Modified | 250 | 500 | 12 | 1.650 | 1.705 | 8.1 |
| Modified | 200 | 200 | 11.75 | 0.778 | 0.843 | 11.0 |
| Modified | 150 | 100 | 11.5 | 0.468 | 0.497 | 6.9 |
| Modified | 150 | 100 | 12 | 0.824 | 0.782 | 9.0 |
| Modified | 150 | 300 | 11 | 0.078 | 0.090 | 8.5 |
| Modified | 150 | 300 | 11.5 | 0.744 | 0.783 | 7.6 |
| Modified | 150 | 300 | 12 | 1.563 | 1.637 | 6.7 |
| Modified | 150 | 500 | 11.5 | 0.778 | 0.823 | 6.7 |
| Modified | 150 | 500 | 12 | 2.186 | 2.228 | 7.1 |
| Modified | 100 | 400 | 11.75 | 1.479 | 1.544 | 6.9 |
| Modified | 50 | 100 | 11 | 0.346 | 0.371 | 15 |
| Modified | 50 | 100 | 12 | 0.701 | 0.752 | 6.9 |
| Modified | 50 | 300 | 11.5 | 0.888 | 0.930 | 11.5 |
| Modified | 50 | 500 | 11 | 0.833 | 0.859 | 4.6 |
| Modified | 50 | 500 | 12 | 1.967 | 2.005 | 7.7 |
| Modified | 0 | 100 | 11 | 0.575 | 0.626 | 8.3 |
| Modified | 0 | 100 | 12 | 0.723 | 0.781 | 10.2 |
| Modified | 0 | 300 | 11.5 | 0.946 | 0.991 | 6.5 |
| Modified | 0 | 500 | 11 | 1.004 | 1.024 | 5.6 |
| Modified | 0 | 500 | 12 | 1.980 | 2.064 | 0.8 |

The results present a complex pattern, but several trends emerge. First, the standard cleaner with or without EDTA even at pH 12 produces very little etch of the substrate. Use of the EDTA in the standard cleaner does seem to improve the filiform corrosion resistance compared to the standard cleaner. Under all conditions of the modified cleaners increasing the pH from 11 or 11.5 to 12 results in an increase in the etching of the substrate and generally to improved performance in the filiform corrosion test. Likewise either increasing the EDTA level or reducing the silicate level at pH 12 seems to increase etching and filiform corrosion resistance. The tested substrate, ACT aluminum alloy 6022 has a relatively low copper level.

In another series of experiments a variety of aluminum alloys were tested in the etching test and filiform corrosion test. The alloys varied in their copper levels as noted below in TABLE 4. The substrates were taken as received from the mill and some were pretreated by the mill as described. In this series of experiments a standard cleaner solution, cleaner A, was compared to a solution prepared according to the present invention, cleaner B, as detailed in TABLE 5 below. In addition, each cleaner solution was tested after being subjected to simulated aging by adding to each 2 grams per liter of Quaker 61AUS oil, a common oil used to treat aluminum sheets, and by reducing the pH to 11 with sodium bicarbonate. Cleaner C was aged cleaner A and cleaner D was aged cleaner B. This was designed to simulate what would happen to a cleaner solution after repeated use, it will pick up oils from the substrates and the pH will go down. The "acid rinsed" substrates were subjected to a very dilute sulfuric acid rinse by the mill. The "as rolled" substrates were not treated in any fashion by the mill except that they were rolled and heat treated. The "acid etched" substrates were etched with a phosphoric and sulfuric acid cleaner by the mill. The "alkaline etched" were etched by alkaline treatment followed by an acid desmut process by the mill. The "Ti/Zr" treatment is a pretreatment with Ti and Zr by the mill to aid in adhesive bonding. The purpose of using these various mill treated substrates was to show that the current invention can be applied to variety of available aluminum substrates. The panels were treated as follows: they were sprayed with the selected cleaner for 60 seconds at 120° F. (48.9° C.); immersion dipped in the selected cleaner for 120 seconds at 120° F. (48.9° C.); rinsed for 30 seconds in a warm water spray; 90 second immersion in a TecTalis® 1800 pretreatment bath at room temperature; rinsed for 30 seconds with deionized water and then blown dry with compressed air. The TecTalis® 1800 bath solutions varied slightly, but they are numbered to allow for comparison of the cleaners. The dried panels were then coated with DuPont Electroshield 21, DuPont 764224EH primer; DuPont 270AC301 Olympic White base coat; and DuPont RK8148 clear coat.

TABLE 4

| Aluminum alloy | Copper content % by weight |
|---|---|
| AA6111 | 0.5-0.9 |
| AA6451 | 0.40 |
| AA6014 | 0.25 |
| AA6016 | 0.20 |

TABLE 5

| Component | Cleaner A grams/ liter of tap water | Cleaner B grams/ liter of tap water |
|---|---|---|
| Sodium gluconate | 0.05 | 0.15 |
| Sodium Trimetaphosphate | 0.45 | 0.75 |
| Potassium Hydroxide (45%) | 4.75 | 9.45 |
| Surfactant (Parco ® Cleaner 1523S) | 1.6 | 1.6 |
| Sodium Hydroxide (50%) | 1.29 | 0.0 |
| Sodium Silicate | 3.28 | 0.11 |
| Tetrasodium EDTA | 0.0 | 0.48 |

The panels as received were treated as described above then subjected to the filiform corrosion testing described above. The average millimeters of filiform corrosion per 10 centimeter scribe was determined for each substrate and is reported below in TABLE 6.

TABLE 6

| Cleaner | TecTalis ® 1800 bath # | AA6451 acid etched creep mm/10 cm | AA6451 as rolled creep mm/10 cm | AA6111 acid rinsed creep mm/10 cm | AA6016 acid rinsed creep mm/10 cm | AA6016 acid etched + TiZr creep mm/10 cm | AA6014 alkaline etched + TiZr creep mm/10 cm |
|---|---|---|---|---|---|---|---|
| A | 1 | 33.6 | 64.5 | 128.6 | 28.3 | 10.5 | 3.9 |
| B | 1 | 5.3 | 7.9 | 27.6 | 1.3 | 6.6 | 0.0 |
| A | 2 | 42.8 | 70.4 | 126.3 | 31.3 | 11.8 | 0.0 |
| B | 2 | 9.2 | 12.5 | 18.1 | 0.0 | 13.2 | 0.7 |
| A | 3 | 61.2 | 148.0 | 210.5 | 16.4 | 19.7 | 10.5 |
| B | 3 | 7.2 | 17.8 | 165.7 | 0.0 | 1.3 | 0.0 |
| C | 3 | 80.3 | 109.2 | 271.1 | 41.4 | 7.9 | 19.1 |
| D | 3 | 25.0 | | 67.8 | 0.0 | 0.0 | 2.0 |
| A | 4 | 73.7 | 146.1 | 194.7 | 15.1 | 10.5 | 15.1 |
| B | 4 | 59.2 | 54.6 | 184.2 | 2.3 | 1.3 | 2.6 |
| C | 4 | 131.6 | 301.3 | 270.4 | 102.0 | 17.1 | 11.8 |
| D | 4 | 50.0 | 3.3 | 18.1 | 0.7 | 0.7 | 5.9 |
| A | 5 | 177.6 | 228.9 | 230.3 | 21.7 | 27.0 | 12.5 |
| B | 5 | 9.2 | 42.8 | 186.5 | 0.0 | 0.0 | 2.6 |
| A | 6 | 59.9 | 145.4 | 221.4 | 13.8 | 8.6 | 8.6 |
| B | 6 | 99.3 | 25.0 | 182.2 | 0.0 | 0.0 | 5.9 |

In another series of experiments the panels were treated as described above except the panels were initially sanded with 180 grit sandpaper to simulate working and then treated as described. The average filiform corrosion across the 10 cm scribe was measured and the results are present in TABLE 7 as the average of duplicates.

TABLE 7

| Cleaner | TecTalis ® 1800 bath # | AA6451 acid etched creep mm/10 cm | AA6451 as rolled creep mm/10 cm | AA6111 acid rinsed creep mm/10 cm | AA6016 acid rinsed creep mm/10 cm | AA6016 acid etched + TiZr creep mm/10 cm | AA6014 alkaline etched + TiZr creep mm/10 cm |
|---|---|---|---|---|---|---|---|
| A | 1 | 3.6 | 4.7 | 9.6 | 2.0 | 2.3 | 1.0 |
| B | 1 | 1.1 | 3.1 | 9.3 | 0.8 | 0.5 | 0.0 |
| A | 2 | 3.1 | 7.2 | 6.3 | 1.0 | 1.3 | 0.3 |
| B | 2 | 1.6 | 1.8 | 6.3 | 0.7 | 0.5 | 0.2 |
| A | 3 | 15.7 | 16.5 | 19.8 | 7.3 | 9.3 | 3.0 |
| B | 3 | 4.0 | 4.5 | 14.7 | 1.5 | 0.8 | 0.6 |
| C | 3 | 12.3 | 18.5 | 17.9 | 7.3 | 3.4 | 2.8 |
| D | 3 | 15.0 | | 16.8 | 4.3 | 3.8 | 2.3 |
| A | 4 | 14.8 | 16.8 | 17.4 | 7.5 | 5.8 | 3.6 |
| B | 4 | 4.2 | 5.1 | 18.4 | 0.7 | 0.8 | 0.8 |

TABLE 7-continued

| Cleaner | TecTalis ® 1800 bath # | AA6451 acid etched creep mm/10 cm | AA6451 as rolled creep mm/10 cm | AA6111 acid rinsed creep mm/10 cm | AA6016 acid rinsed creep mm/10 cm | AA6016 acid etched + TiZr creep mm/10 cm | AA6014 alkaline etched + TiZr creep mm/10 cm |
|---|---|---|---|---|---|---|---|
| C | 4 | 13.2 | 14.6 | 15.4 | 4.6 | 2.9 | 3.6 |
| D | 4 | 13.8 | 11.7 | 19.0 | 5.4 | 4.5 | 4.0 |
| A | 5 | 20.1 | 22.3 | 21.1 | 9.0 | 14.4 | 10.2 |
| B | 5 | 4.5 | 3.8 | 20.7 | 0.3 | 0.7 | 0.8 |
| A | 6 | 18.5 | 15.3 | 17.7 | 4.5 | 4.2 | 14.8 |
| B | 6 | 7.8 | 9.0 | 16.4 | 0.5 | 0.8 | 2.3 |

The amount of metal etching was also determined by spraying substrate panels for 60 seconds with the selected cleaner at 120° F. (48.9° C.) and then immersion for 120 seconds in the selected cleaner at 120° F. (48.9° C.). The results are present below in TABLE 8 as grams per meter squared of metal removed. The results show that cleaners prepared according to the present invention show much higher etch rates on a variety of aluminum-based substrates compared to a standard cleaner. In addition, the results show a large reduction in filiform corrosion on panels cleaned with a cleaner designed according to the present invention compared to a standard cleaner.

TABLE 8

| Cleaner | AA6451 acid etched $g/m^2$ | AA6451 as rolled $g/m^2$ | AA6111 acid rinsed $g/m^2$ | AA6016 acid rinsed $g/m^2$ | AA6016 acid etched + TiZr $g/m^2$ | AA6014 alkaline etched + TiZr $g/m^2$ |
|---|---|---|---|---|---|---|
| A | 0.15 | 0.15 | 0.10 | 0.15 | 0.24 | 0.05 |
| B | 2.86 | 2.72 | 3.01 | 2.28 | 2.42 | 3.10 |
| C | 0.15 | 0.10 | 0.00 | 0.00 | 0.10 | 0.15 |
| D | 1.16 | 1.07 | 1.12 | 1.16 | 1.12 | 1.12 |

In another series of experiments panels of AA6111 acid rinsed and AA6451 as rolled were subjected to another corrosion testing protocol. In this series of experiments the standard cleaner solution, cleaner A, was compared to a solution prepared according to the present invention, cleaner B, as detailed in TABLE 5 above. In addition, each cleaner solution was tested after being subjected to simulated aging by adding to each 2 grams per liter of Quaker 61AUS oil, a common oil used to treat aluminum sheets, and by reducing the pH to 11 with sodium bicarbonate. Cleaner C was aged cleaner A and cleaner D was aged cleaner B. The "acid rinsed" substrates were subjected to a very dilute sulfuric acid rinse by the mill. The "as rolled" substrates were not treated in any fashion by the mill except that they were rolled and heat treated. The panels were treated as follows: they were sprayed with the selected cleaner for 60 seconds at 120° F. (48.9° C.); immersion dipped in the selected cleaner for 120 seconds at 120° F. (48.9° C.); rinsed for 30 seconds in a warm water spray; 90 second immersion in a TecTalis® 1800 pretreatment bath at room temperature; rinsed for 30 seconds with deionized water and then blown dry with compressed air. The TecTalis® 1800 bath solutions varied slightly, but they are numbered to allow for comparison of the cleaners. The dried panels were then coated as described above with DuPont Electroshield 21, DuPont 764224EH primer; DuPont 270AC301 Olympic White base coat; and DuPont RK8148 clear coat.

The corrosion testing protocol was as described below. Each panel was scribed down to the substrate horizontally and placed at an angle of 15 to 20° from the vertical for the duration of the testing. During a first 6 hour period the panels were sprayed at the start, middle and end of the 6 hours with a 0.5% NaCl solution such that 5 to 10 liters per meter squared of panel was applied over the 6 hour period. The chamber was kept at 25° C. and 95% relative humidity during the 6 hours. Then over a 2.5 hour period the panels were dried by diffusion under climate control such that the temperature was stepped up to 40° C. and then to 50° C. and the relative humidity was moved down from 95% to 70%. The panels were then kept at 50° C. and 70% relative humidity for an additional 15.5 hours to complete the first 24 hour cycle. This 24 hour cycle was repeated an additional 4 times. After completion of the fifth 24 hour cycle the panels were kept at 50° C. and 70% relative humidity for another 48 hours. Multiple panels for each condition were then evaluated for filiform corrosion creep across the scribe and the results averaged. The results are present below in TABLE 9 as average creep across the scribe in millimeters. The amount of metal etching was also determined by spraying substrate panels for 60 seconds with the cleaner at 120° F. (48.9° C.) and then immersion in the cleaner for 120 seconds at 120° F. (48.9° C.). The results are present below in TABLE 10 as grams per meter squared of metal removed.

TABLE 9

| Cleaner | TecTalis ® 1800 bath | AA6451 creep mm/10 cm | AA6111 creep mm/10 cm |
|---|---|---|---|
| A | 1 | 13.1 | 14.6 |
| B | 1 | 2.6 | 1.0 |
| A | 2 | 7.4 | 13.5 |
| B | 2 | 2.0 | 2.7 |
| A | 3 | 12.4 | 14.0 |
| B | 3 | 4.0 | 5.1 |
| C | 3 | 17.6 | 10.4 |
| D | 3 | | 9.4 |
| A | 4 | 15.5 | 15.6 |
| B | 4 | | 27.2 |
| C | 4 | 17.8 | 32.6 |
| D | 4 | 1.7 | 7.1 |

TABLE 10

| Cleaner | AA6451 g/m$^2$ | AA6111 g/m$^2$ |
|---|---|---|
| A | 0.15 | 0.10 |
| B | 2.72 | 3.01 |
| C | 0.10 | 0.00 |
| D | 1.07 | 1.12 |

The results again demonstrate the value of the present invention in terms of enhancing the corrosion protective effects of the pretreatment solution, in this case TecTalis® 1800. In addition, aging of the bath did not prevent the enhancement effect.

In the next series of experiments the aluminum substrate AL6111 was treated similarly as described above for the data in TABLE 3 with the following modifications. For the etch studies the cleaner was applied as a spray for 60 seconds followed by immersion in a bath of the cleaner for 120 seconds. For testing the filiform corrosion the process was as follows: the panels were sprayed with the cleaner for 60 seconds; immersed in a bath of the cleaner of 120 seconds; rinsed with warm water for 30 seconds; rinsed with deionized water for 30 seconds expect for the standard cleaner with B958 which was conditioned for 30 seconds instead; the TecTalis® 1800 pretreatment was for 90 seconds while the B958 pretreatment was for 120 seconds; the B958 samples were then rinsed with cold water for 30 seconds; and then the standard or modified treated panels were rinsed with deionized water for 30 seconds while the B958 panels were rinsed for 15 seconds. The standard cleaner was Parco® Cleaner 1533 modified as noted below in TABLE 11. The etch rate and filiform corrosion are also provided in TABLE 11 in all cases expect as noted the pretreatment used after the cleaner was TecTalis® 1800. The results show that as the etch rate reaches 1 gram/meter squared and beyond the reduction in filiform corrosion is quite significant. In addition, the cleaners according to the present invention in combination with TecTalis® 1800 are significantly better than B-958 in providing corrosion resistance at the higher etch rates.

TABLE 11

| Cleaner | EDTA ppm | Silicate ppm | pH | Filiform mm/10 cm | Etch grams/meter$^2$ |
|---|---|---|---|---|---|
| Standard 1533 + TecTalis ® 1800 | 0 | 650 | 12 | 31.93 | |
| Standard 1533 + B-958 | 0 | 650 | 12 | 15.68 | |
| Modified + TecTalis ® 1800 | 100 | 0 | 12.5 | 33.79 | 0.97 |
| Modified + TecTalis ® 1800 | 500 | 0 | 12.5 | 17.57 | 3.62 |
| Modified + TecTalis ® 1800 | 300 | 125 | 12.5 | 15.21 | 2.26 |
| Modified + TecTalis ® 1800 | 100 | 250 | 12.5 | 24.02 | 1.45 |
| Modified + TecTalis ® 1800 | 500 | 250 | 12.5 | 33.13 | 1.07 |
| Modified + TecTalis ® 1800 | 100 | 0 | 11.5 | 26.17 | 1.07 |
| Modified + TecTalis ® 1800 | 500 | 0 | 11.5 | 6.72 | 3.07 |
| Modified + TecTalis ® 1800 | 300 | 125 | 11.5 | 5.85 | 1.52 |
| Modified + TecTalis ® 1800 | 100 | 250 | 11.5 | 34.48 | 0.45 |
| Modified + TecTalis ® 1800 | 500 | 250 | 11.5 | 24.14 | 1.07 |

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method of cleaning an aluminum or aluminum alloy substrate with a high etch cleaner comprising the steps of:

a) providing a cleaner comprising 25 to 250 ppm of silicate, 50 to 500 ppm of at least one chelator selected from the group consisting of ethylenediamine tetraacetic acid (EDTA) or its salts, nitrilo triacetic acid (NTA) or its salts, diethylene triamine pentaacetic acid (DTPA) or its salts, iminodisuccinic acid or its salts, S,S'-ethylenediaminedisuccinic acid (EDDS) or its salts, tartaric acid or its salts, and any mixture thereof, and said cleaner having a pH of from 11.0 to 13.5; and b) exposing a substrate comprising aluminum or an aluminum alloy to said cleaner for a period of time of from 30 seconds to 240 seconds and to thereby etch from 0.5 to 4.0 grams per square meter of aluminum from said substrate.

2. The method as recited in claim 1 wherein step a) further comprises providing a cleaner comprising: 100 to 1235 ppm of sodium, 880 to 3950 ppm of potassium, 510 to 1790 ppm of hydroxide, 0 to 775 ppm of at least one phosphate, 0 to 270 ppm of tartrate, and 0 to 340 ppm of nitrate.

3. The method as recited in claim 2 wherein the at least one phosphate comprises a tripolyphosphate, a trimetaphosphate, an orthophosphate, a pyrophosphate, a tetraphosphate, or a mixture thereof.

4. The method as recited in claim 1 wherein step b) comprises exposing said substrate to said cleaner at a temperature of from 110 to 140° F. (43.3 to 60.0° C.).

5. The method as recited in claim 1 wherein step b) comprises at least one of spraying said cleaner onto said substrate, immersing said substrate in a bath of said cleaner, or a mixture thereof.

6. The method as recited in claim 1 wherein step b) comprises first spraying said cleaner onto said substrate followed by immersion of said substrate in a bath of said cleaner.

7. The method as recited in claim 1 wherein step b) comprises spraying said cleaner onto said substrate for a period of time of at least 60 seconds.

8. The method as recited in claim 1 wherein step b) comprises immersing said substrate in said cleaner for a period of time of at least 120 seconds.

9. The method as recited in claim 1 comprising after step b) the further step of rinsing said substrate with water.

10. The method as recited in claim 9 comprising the further step of applying to said rinsed substrate an anti-corrosion pretreatment.

* * * * *